United States Patent [19]

Delphia

[11] Patent Number: 4,655,212

[45] Date of Patent: Apr. 7, 1987

[54] FRESH-AIR SNORKEL

[76] Inventor: John B. Delphia, 1021 Schuyler Dr., Milford, Mich. 48042

[21] Appl. No.: 720,454

[22] Filed: Apr. 4, 1985

Related U.S. Application Data

[63] Continuation-in-part of Ser. No. 553,506, Nov. 21, 1983, abandoned.

[51] Int. Cl.[4] ..... B63C 11/18; B63C 11/16

[52] U.S. Cl. ..... 128/201.11

[58] Field of Search ..... 128/201.11, 201.27, 128/207.14, 207.16, 200.29, 200.15, 201.28

[56] References Cited

U.S. PATENT DOCUMENTS

| | | | |
|---|---|---|---|
| 3,860,042 | 1/1975 | Green | 128/201.11 |
| 4,071,024 | 1/1978 | Blanc | 128/201.11 |
| 4,278,080 | 7/1981 | Schuch | 128/201.11 |
| 4,467,797 | 8/1984 | Franke | 128/200.29 |

FOREIGN PATENT DOCUMENTS

| | | | |
|---|---|---|---|
| 918008 | 9/1946 | France | 128/201.11 |
| 312092 | 6/1969 | Sweden | 128/201.11 |

*Primary Examiner*—Henry J. Recla

*Attorney, Agent, or Firm*—Reising, Ethington, Barnard, Perry & Milton

[57] ABSTRACT

A diving snorkel assembly (10) including a snorkel tube (12) having an air inlet end (14) and a mouthpiece (16). The snorkel tube (12) defines a fluid passageway (18) extending between the end (14) of the tube (12) and the mouthpiece (16). An exhaust valve (24) is disposed between the mouthpiece (16) and the end (14) of the tube (12) for allowing one-way exhaust of fluid from the fluid passageway (18). An exhaust baffle (26) extends across the fluid passageway (18) adjacent to the exhaust valve (24) for establishing an exhaust fluid flow from the mouthpiece (16) through the fluid passageway (18) toward the exhaust valve (24) in response to air pressure from the mouthpiece (16).

23 Claims, 9 Drawing Figures

FRESH-AIR SNORKEL

This is a continuation-in-part of application Ser. No. 553,506 filed Nov. 21, 1983 now abandoned.

TECHNICAL FIELD

The instant invention relates to a fresh-air diving snorkel of the type used in the sport of skin diving.

BACKGROUND ART

Diving snorkel assemblies are used by skin divers for breathing air above the water without having to bring one's head out of the water. Various structures of snorkels have been devised in an attempt to eliminate entrapped water within the main tube of the snorkel while concomitantly eliminating carbon dioxide which also tends to build up in the tube. Diving snorkel assemblies have been made with separate intake and exhaust valves in an attempt to draw inlet air through the inlet valve while purging water and exhaust air through a separate exhaust valve. Examples of such prior art assemblies are disclosed in U.S. Pat. No. to Green 3,860,042, issued Jan. 4, 1975 and Schuch U.S. Pat. No. 4,278,080 issued July 14, 1981. There remains a problem of directing the exhaust fluid flow within the snorkel assembly towards the exhaust valve. Prior art assemblies do not include means for directing the exhaust flow to escape through the exhaust valve with the concomitant exhaust of entrapped water within the snorkel tube. In view of this problem, the instant invention include exhaust baffling means for establishing an exhaust fluid flow which will further increase the efficiency of the elimination of carbon dioxide and water build-up entrapped in the snorkel tube.

Additionally, prior art snorkel exhaust air ports have been located at the base of the mouthpiece. This design facilitates the expulsion of water trapped in the tube but inhibits the expulsion of air. This is due to the pressure differential created by the distance between the exhaust port and the surface of the water. The instant invention further provides an embodiment utilizing the advantages of the exhaust baffling means of the instant invention to provide reduced exhaust effort by locating the exhaust port at a point normally closer to the water surface than the location of the exhaust ports in prior art assemblies. In this manner, the breathing effort is facilitated. High performance breathing of fresh-air in the snorkel tube is maintained as the system eliminates dead air breathing as is encountered in prior art snorkels where both air intake and exhaust are from the top of the snorkel tube. In this manner, the instant invention provides quick effortless expulsion of all water that enters the snorkel assembly.

STATEMENT OF THE INVENTION

In accordance with the present invention, there is provided a diving snorkel assembly including a snorkel tube having an air inlet end and mouthpiece with the snorkel tube defining a fluid passageway extending between the end of the snorkel tube and the mouthpiece. Exhaust valve means is disposed between the mouthpiece and the end of snorkel tube for allowing one-way exhaust of fluid from the fluid passageway. The assembly is characterized by including exhaust baffling means for establishing an exhaust fluid flow from the fluid passageway toward the exhaust valve means in response to exhaust air pressure from the mouth- piece.

FIGURES IN THE DRAWINGS

An embodiment of the diving snorkel assembly constructed in accordance with the present invention will now be described, by way of example only, with reference to the accompanying drawings, in which.

DETAILED DESCRIPTION OF THE DRAWINGS

Figure 1:
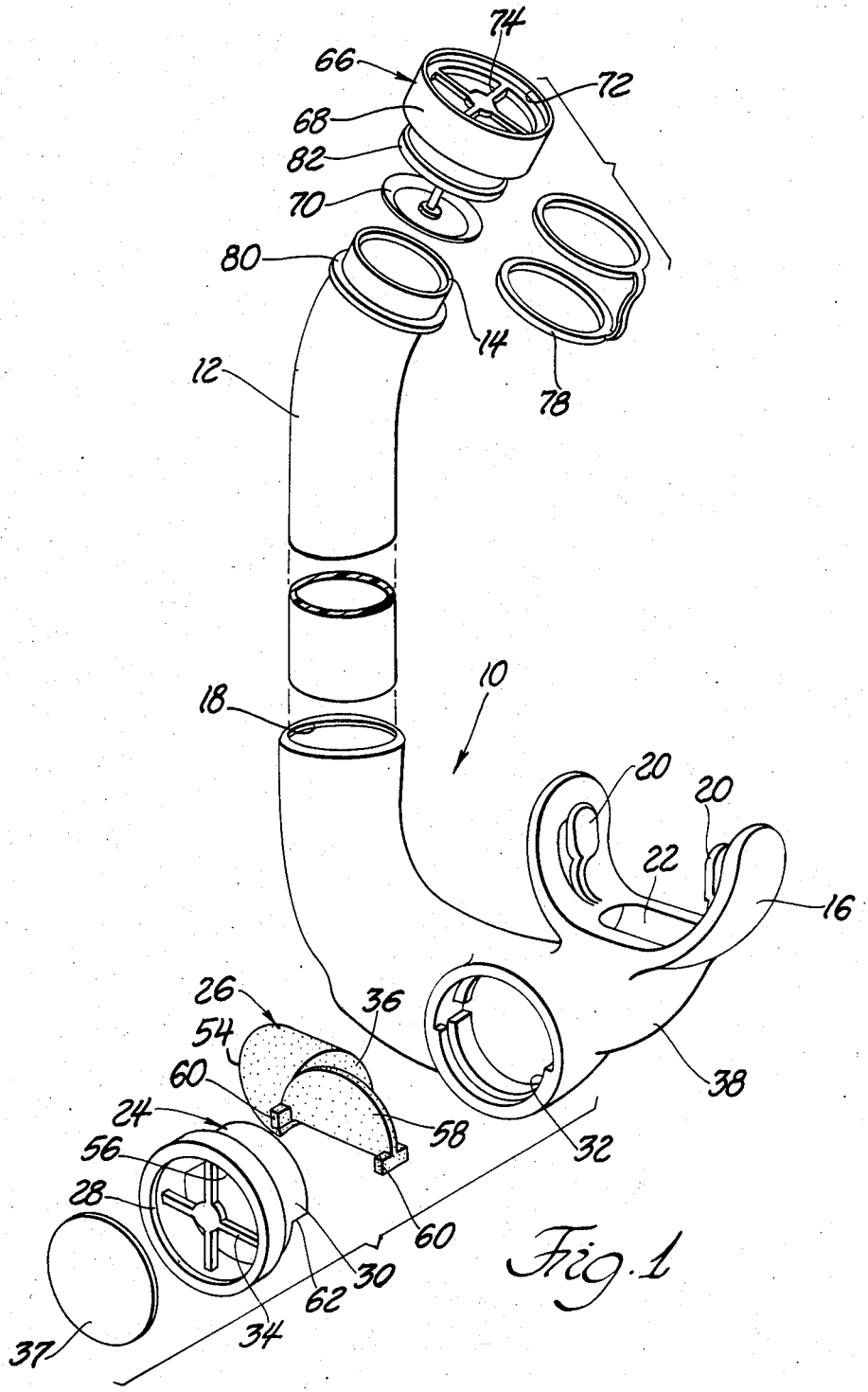
FIG. 1 is a perspective exploded view of the subject invention.

Referring to the Figures, a diving snorkel assembly constructed in accordance with the instant invention is generally shown at 10.

The assembly includes a snorkel tube 12 having an inlet end 14. A mouthpiece 16 extends integrally from the snorkel tube at the opposite end thereof. Alternatively, the mouthpiece 16 may be formed as a separate part and attached to the snorkel tube assembly 10 by means well known in the art. The snorkel tube 12 defines a fluid passageway 18 extending between the inlet end 14 of the tube 12 and the mouthpiece 16. In normal use, inlet air is drawn in through the end 14 of the snorkel tube 12 by suction on the mouthpiece 16. The mouthpiece 16 may include projecting knobs 20 which are retained by the teeth of the diver. The projections 20 are disposed about an opening 22 of the fluid passageway 18 and extend into the mouthpiece 16. Exhaust valve means generally indicated at 24 is disposed between the mouthpiece 16 and the end 14 of the snorkel tube 12 for allowing one-way exhaust of fluid from the fluid passageway 18. In normal use, exhaust air from the diver is forced through the opening 22 in the mouthpiece 16 and out through the exhaust valve means 24. The exhaust valve means 24 is a one-way valve which does not allow the inlet of air therethrough in response to the intake of air by the diver through the inlet end 14 of the tube 12 and the mouthpiece 16.

The assembly 10 is characterized by including exhaust baffling means generally indicated at 26 for establishing an exhaust fluid flow from the mouthpiece 16 through the fluid passageway 18 toward the exhaust valve means 24 in response to air pressure from the mouthpiece 16. In other words, the exhaust baffling means 26 directs or baffles the exhaust air flow from the divers mouth through the mouthpiece 16 toward the exhaust valve means 24 as opposed to allowing the exhaust air to travel back up through the snorkel tube 12 and out the end portion 14 thereof. More specifically, the exhaust valve means 24 defines an exhaust passageway 28. It is desirable that the exhaust air travel out through the exhaust passageway 28 passing through the exhaust valve means 24 as opposed to traveling back through the tube 12. In this manner, trapped water and exhaust gases are removed from the assembly as opposed to being trapped within the assembly and rebreathed by the diver. As shown in FIG. 1, the exhaust valve means 24 comprises a cylindrical housing 30 defining the exhaust passageway 28 therethrough which is force-fit or glued into an opening 32 in the snorkel tube 12. Cross webbing 34 retains a diaphragm member 37 so as to allow exhaust fluid flow while preventing the intake of fluid therethrough in response to intake of air by the diver through the mouthpiece 16. This type of one-way valve is well-known in the art.

Figure 3:
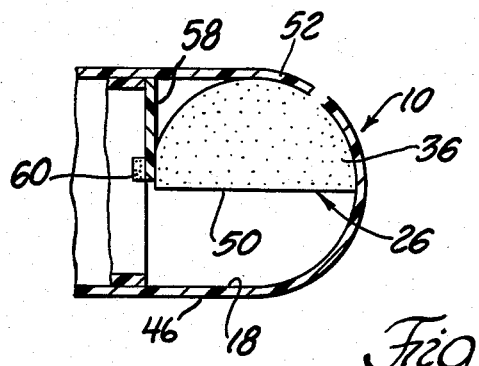
FIG. 3 is a cross-sectional view taken substantially along lines 3—3 of FIGS. 2.
Figure 4:
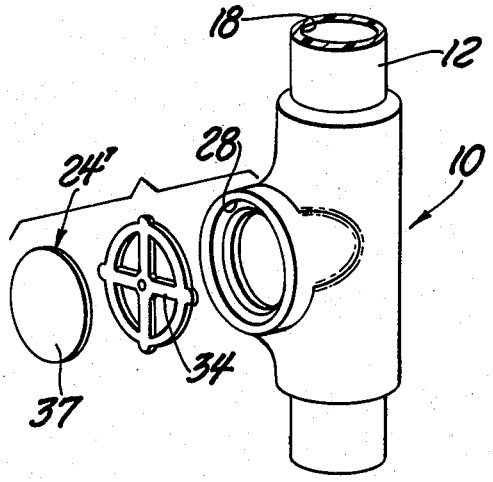
FIG. 4 is fragmentary exploded perspective view of a second embodiment of the instant invention.

The baffling means 26 includes a wall portion 36 extending inwardly from the exhaust passageway 28 and across the fluid passageway 18 to direct or baffle the flow of exhaust fluid through the fluid passageway 18 and into the exhaust passageway 28, as shown in FIG. 3. The wall portion 36 is adjacent to the exhaust passageway 28 the down stream side thereof relative to the mouthpiece 16. The wall portion 36 breaks or disrupts the flow of exhaust air through the fluid passageway 18 so as to disrupt the momentum of the fluid flow proximately or adjacent to the exhaust passageway 28. The wall portion 36 establishes a fluid flow from the fluid passageway 18 toward the exhaust valve 24.

A neck portion 38 extends from the mouthpiece 16 and includes an inner passageway or cross section 40 having a predetermined cross-sectional area, i.e., diameter. The fluid passageway 18 has a predetermined cross-sectional area, i.e., diameter, which is greater than the predetermined area or diameter of the cross-sectional area of inner passageway 40 of the neck portion 38. The fluid passageway 18 expands in cross sectional area at a position or point 42 directly adjacent to and below the inner cross section of passageway 40 of the neck portion 38, as shown in cross section in FIG. 2. The fluid passageway 18 decreases or tapers in cross-sectional area from the point 42 of expansion of the fluid passageway 18 toward the inlet end 14 of the snorkel tube 12. The fluid passageway 18 decreases in area or tapers from the point 42 to the position or point 44 which is spaced from the inlet end 14 of the snorkel tube 12. The snorkel tube 12 has a substantially constant inner diameter or cross sectional area from the point 44 to the inlet end 14 thereof. It is in this expanded area of the tube 12 that water settles so at to be located near the exhaust valve means 24. This construction together with the baffling means 26 to more efficiently remove the pooled water from the tube.

Figure 2:
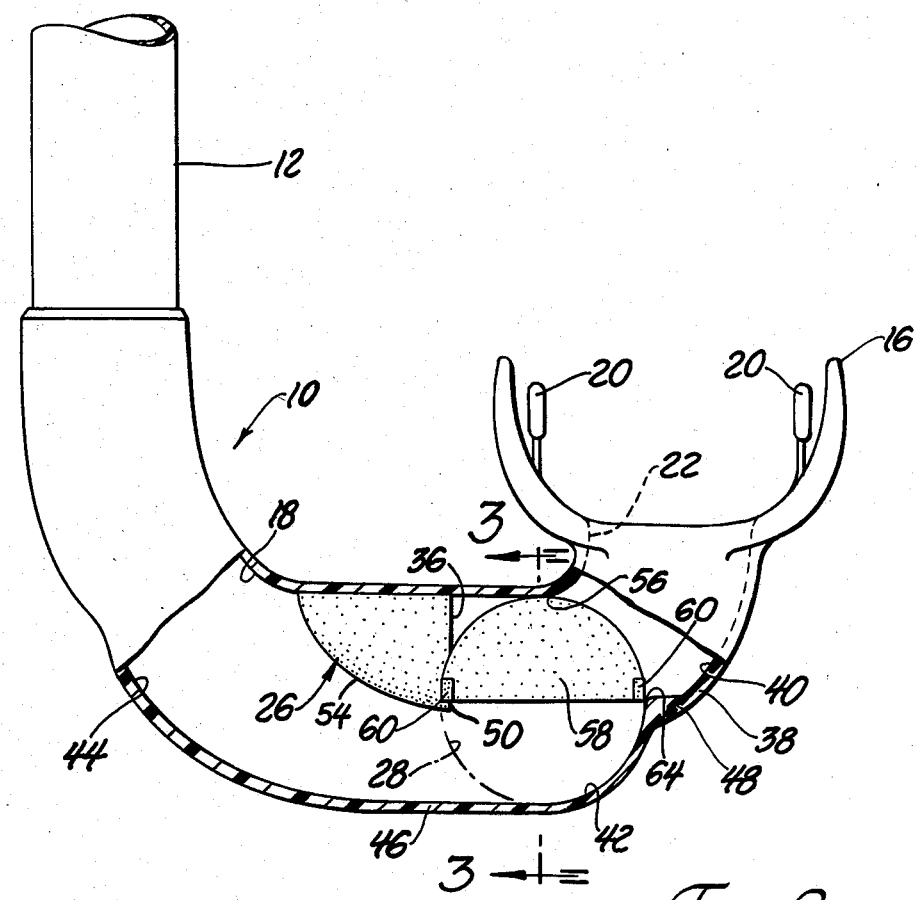
FIG. 2 is an elevational view in cross section.

The exhaust valve means 24 extends perpendicularly from the fluid passageway 18 at a position adjacent or proximate to the neck portion 38. The fluid passageway 18 and the inner passageway 40 of the neck portion 38 each have a lower extremity 46 and 48, respectively, as shown in FIG. 2. The fluid passageway 18 has a greater cross sectional area than the neck portion 38 adjacent to the lower extremity 48 of the neck portion 38. In other words, the lower extremity 46 of the fluid passageway 18 not only dips below the lower extremity 48 of the neck portion 38, but also the fluid passageway 18 has a larger cross sectional area or expands adjacent or proximately to the neck portion 38. Thus, the lower extremity 46 of the fluid passageway 18 is displaced downwardly from the lower extremity 48 of the neck portion 38. Pooled water within this expanded area is forced out of the tube 12 by the redirected exhaust air flow created by the baffling means 26.

The wall portion 36 has a lower edge 50 and the fluid passageway 18 has an upper extremity 52. The wall portion 36 extends completely across the fluid passageway 18 and downwardly from upper extremity 52 of the fluid passageway 18 to the position level or even with the lower extremity 48 of the neck portion 38. In other words, the wall portion 36 extends downwardly from the upper extremity 52 of the fluid passageway 18 so as to block the path of exhaust air flowing through the inner passageway 40 of the neck portion 38, the wall portion 36 being spaced from the edge of the inner passageway 40.

The fluid passageway 18 includes an opening when viewed in cross section as shown in FIG. 3, defined by the bottom edge 50 of the wall portion 36 and the remainder of the fluid passageway 18. The opening has a constricted cross sectional area relative to the remainder of the fluid passageway 18. The assembly includes inlet fluid control means for gradually decreasing the cross sectional area of the fluid passageway 18 approaching the opening from the inlet end 14 of the tube 12. More specifically, the fluid flow control means includes an upper surface 54 of the fluid passageway 18 blending smoothly downwardly from a point spaced from the inlet end 14 of the snorkel tube 12 to the bottom edge 50 of the wall portion 36. The upper surface 54 gradually decreases the effective cross sectional area or diameter of the fluid passageway 18 from the snorkel tube 12 to the wall portion 36 for creating a flow effect which increases the efficiency of inlet fluid flow past the wall portion 36.

The exhaust passageway 28 has a lower portion below the bottom edge 50 of the wall portion 36. The assembly 10 includes exhaust fluid control means for directing exhaust fluid flow through the lower portion of the exhaust passageway 28 whereby water trapped within the fluid passageway 18 is forced out through the exhaust passageway 28 with the exhaust flow of fluid. Additionally, any entrapped carbon dioxide is concomitantly forced out through the exhaust passageway 28. Specifically, the exhaust passageway 28 includes an upper extremity 56. The exhaust fluid flow control means includes a second wall portion 58 extending downwardly from the upper extremity 56 of the exhaust passageway 28 to a point about level or a position approximately even with the lower edge 50 of the first-mentioned wall portion 36. As shown in FIG. 1, the first and second-mentioned wall portions 36 and 58, respectively, may be made as a single integral unit. The unit would be inserted into the fluid passageway 18 of the snorkel tube 18 as a subassembly during the fabrication of the snorkel tube assembly 10 prior to connection of the exhaust valve means 24 to the snorkel tube 12.

The second-mentioned wall portion 58 includes alignment means for aligning the wall portion 58 with the exhaust passageway 28. The alignment means includes a pair of flanges or tabs 60 extending from the wall portion 58. The exhaust passageway 28 has side surfaces including a pair of seats 62 for mating engagement with the flanges 60. The seats 62 may take the form of a groove or notch 62 on the outside of the side surfaces of the exhaust passageway. As the unit including the first and second mentioned walls 36, 58 are disposed within the fluid passageway 18 and the valve means 24 is force-fit and/or glued into the opening 32, the flange 60 are force-fit into the seats 62 so as to align the entire assembly.

The neck portion 38 is formed from an annular wall, the annular wall including a projection or thicker portion 64 extending into the inner passageway 40 from the lower extremity thereof adjacent to the fluid passageway 18. The projection 64 produces an anticoanda effect. Normally, adhesion effects of fluid flow would cause fluid to adhere to the sidewalls of a tubular structure, thereby producing a coanada effect. The projection 64 disrupts the fluid flow so that the fluid tends not to adhere to the walls of the tube, but rather flows against the wall portion 36 so as to be disrupted whereby a fluid flow is established toward the exhaust valve means 24. It has also been found that if there is a sufficient drop from the lower extremity 48 of the neck portion 38 to the lower extremity 46 of the fluid passageway 18, then a similar anticoanda effect is obtained with or without the projection 64.

The assembly 10 may include inlet valve means generally indicated at 66 in FIG. 1. The inlet valve means 66 allows one-way flow of fluid into the snorkel tube 12. The inlet valve means 66 includes a housing 68 enclosing a diaphragm 70 which seals the passageway 72 extending through the housing 68 in response exhaust pressure, thereby preventing exhaust fluid flow therethrough. Cross posts 74 retain the diaphragm 70 within the passageway 72. An elastic band 78 may be provided for engaging a flange 80 on the snorkel tube 12 and a second flange 82 on the inlet valve housing 68 for retaining the inlet valve 66 adjacent the snorkel tube 12 when the inlet valve 66 is removed therefrom. Thusly, the inlet valve may either be used with the assembly 10 or may be removed, yet retained therewith and may be a type well-known in the art.

A second embodiment of the instant invention is shown in FIGS. 4 through 9. Like numerals are used to indicate similar structure between the several embodiments.

Figure 9:
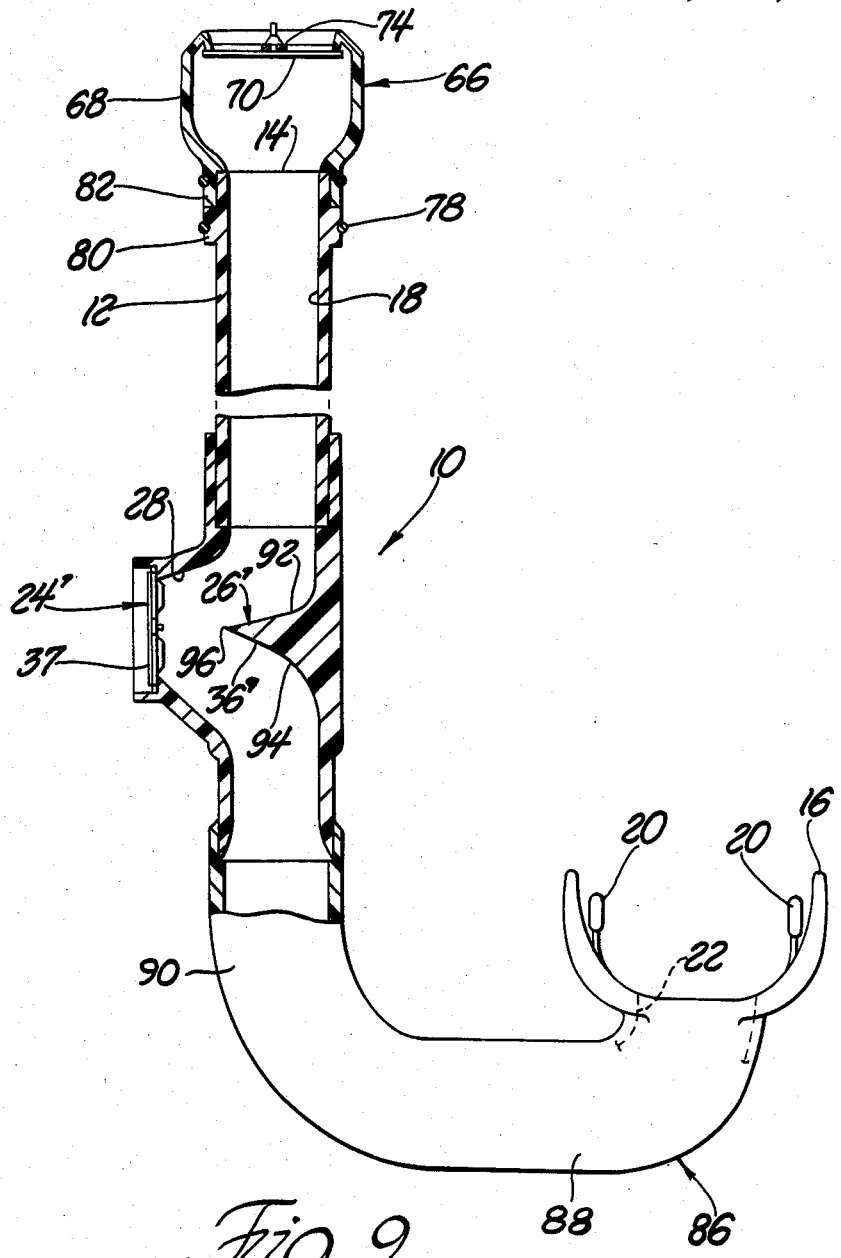
FIG. 9 is a side view partially broken away of the instant invention.

As shown in FIG. 9, the tube 12 includes a neck portion 86 extending from the mouthpiece 16. The neck portion 86 is substantially L-shaped and includes a first leg 88 extending from the mouthpiece 16 and a second leg 90 extending substantially perpendicular from the first leg 88 to the inlet end 14. The exhaust valve means 24' extends from the second leg 90 and is spaced from the inlet end 14. In this manner, the exhaust valve means 24' is disposed on a position on the tube 12 at a location at or near the water surface when the tube is in use. One-way valve means is used, the structure of which being discussed above.

Figure 5:
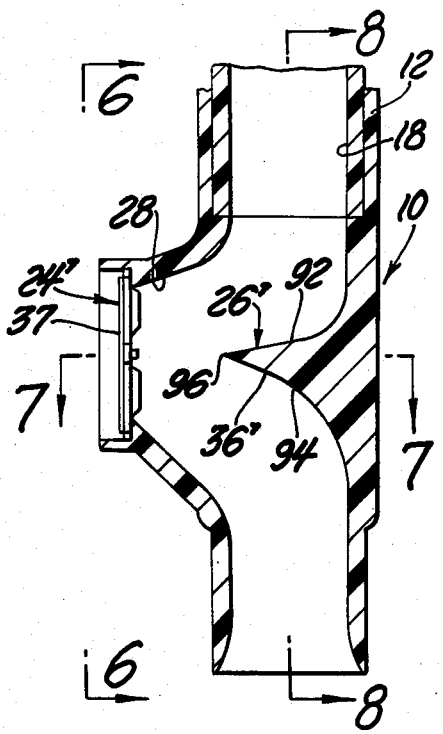
FIG. 5 is a cross sectional view of the embodiment shown in FIG. 4.
Figure 6:
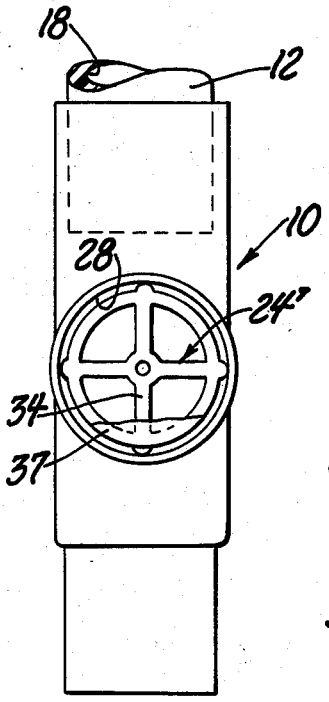
FIG. 6 is a view taken substantially along lines 6—6 of FIG. 5.
Figure 7:
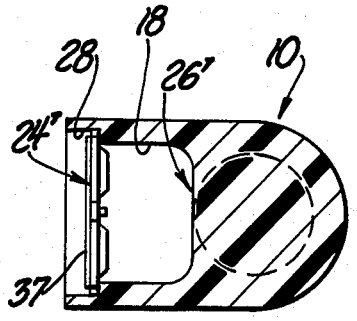
FIG. 7 is a cross sectional view taken substantially along lines 7—7 of FIG. 5.
Figure 8:
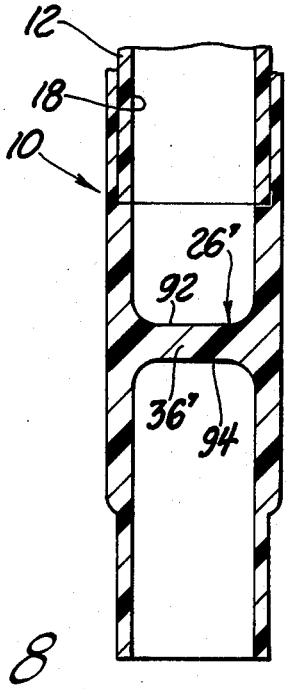
FIG. 8 is a cross sectional view taken substantially along lines 8—8 of FIG. 5.

The exhaust baffling means 26' includes a wall portion 36' extending substantially across the fluid passageway 18' from the tube 12 opposite to the exhaust valve means 24' as shown in FIGS. 5 and 9. The wall portion 36 has an upstream side 92 and a downstream side 94 each having a smooth curved surface merging with the fluid passageway 18. The upstream and downstream sides 92,94 merge together towards the exhaust valve means 24' at a sharp peripheral end 96.

The location of the exhaust valve means 24' in relation to the exhaust baffling means 26' takes advantage that water is most easily expelled from the snorkel when the water outlet is below or just below the water surface and air is most easily expelled from a snorkel when the air outlet is just below or above the water surface. The exhaust valve location as in the present invention when combined with the air inlet valve at the top of the snorkel provides a dry snorkel with minimal exhaust effort for easy breathing and easy expulsion of any water that might enter the tube. In addition, the location of the exhaust valve means 24' away from the mouthpiece 16 allows nonhanded use of the snorkel 10. In other words, the snorkel 10 may be worn such that the inlet and outlet ports may be either on the left or righthand side of the user.

Exhaust noise with the instant invention does not present a problem as the location of the exhaust valve on the tube 12 may face in a three quarter rear attitude thus eliminating the potential of water entering the exhaust while swimming forward at a fast pace as air is exhausted outwardly.

The exhaust baffling means 26' provides a circular blocking area directing all air and any water that is in the tube out of the side exhaust valve means 24'. Its prime function is to stop air from flowing past the water in the tube without drawing the water out the exhaust valve means 24' with it. The exhaust valve means 24' is located near the exhaust baffling means 26' so there is a direct flow of air/water out into the surrounding water. The exhaust valve means 24' is located on the outside of the snorkel to minimize any discomfort to the ear of the user. Its location is close to the water's surface to minimize exhaling effort.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A diving snorkel assembly (10) comprising: a snorkel tube (12) having an air inlet end (14) and an opposite end; a mouthpiece (16) at said opposite end of said tube (12), said tube (12) defining a fluid passageway (18) extending between said inlet end (14) of said tube (12) and said mouthpiece (16); exhaust valve means (24,24') disposed between said mouthpiece (16) and said inlet end (14) of said tube (12) for allowing one-way exhaust of fluid from said fluid passageway (18); and exhaust baffling means (26,26') for establishing an exhaust fluid flow from said mouthpiece (16) through said fluid passageway (18) toward said exhaust valve means (24,24') in response to air pressure from said mouthpiece, said exhaust valve means (24,24') defining an exhaust passageway (28) extending laterally from and in fluid communication with one side of said fluid passageway (18), said baffling means (26,26') including a wall portion (36') extending inwardly from the opposite side of said fluid passageway (18) toward said exhaust passageway (28) to direct the flow of exhaust fluid through said fluid passageway (18) into said exhaust passageway (28).

2. An assembly as set forth in claim 1 further characterized by including a U-shaped neck portion (38) extending from said mouthpiece (16) and including two legs and an intermediate portion, said legs defining an upward direction from said intermediate portion, said neck portion including an inner cross section (40) having a first predetermined area, said fluid passageway (18) having a second predetermined cross sectional area greater than said first predetermined area adjacent to said innner cross section (40) wherein said fluid passageway (18) expands in cross sectional area at a position (42) directly adjacent to and downwardly from said inner cross section (40) of said neck portion (38) and decreases in cross sectional area toward said inlet end (14) of said snorkel tube (12).

3. An assembly as set forth in claim 3 further characterized by said fluid passageway (18) and said inner cross section (40) each having a lower extremity (46,48) on the downward most side thereof, said lower extremity (46) of said fluid passageway (18) being displaced downwardly from said lower extremity (48) of said inner cross section (40) at a position adjacent to said neck portion (38).

4. A diving snorkel assembly (10) comprising: a snorkel tube (12) having an air inlet end (14) and an opposite end; a mouthpiece (16) at said opposite end of said tube (12), said tube (12) defining a fluid passageway (18) extending between said inlet end (14) of said tube (12) and said mouthpiece (16); exhaust valve means (24) disposed beween said mouthpiece (16) and said inlet end (14) of said tube (12) for allowing one-way exhaust of fluid from said fluid passageway (18); and exhaust baffling means (26) for establishing an exhaust fluid flow from said mouthpiece (16) through said fluid passageway (18) towards said exhaust valve means (24) in response to air pressure from said mouthpiece, said exhaust valve means (24) defining an exhaust passageway (28) forking from and in fluid communication with said fluid passageway (18), said baffling means (26) including a wall portion (36) extending inwardly from said fluid passageway (18) to direct the flow of exhaust fluid through said fluid passageway (18) into said exhaust passageway (28), said wall portion (36) being adjacent to said exhaust passageway (28) on the side thereof opposite relative to said mouthpiece (16), said snorkel tube including a U-shaped neck portion (38) and including two legs and an intermediate portion, one of said legs being connected to said mouthpiece, the fluid passageway (18) in said one leg, said neck portion including an inner cross section (40) in said intermediate portion having a first predetermined area, said fluid passageway (18) having a second predetermined cross section area greater than said first predetermined area adjacent to said inner cross section (40) and expanding in an opposite direction to said mouthpiece wherein said fluid passageway (18) expands in cross-sectional area at a position (42) directly adjacent to and away from said inner cross section (40) of said neck portion (38) and decreases in cross-sectional area toward said inlet end (14) of said snorkel tube (12), said snorkel tube, when in normal use, defining said fluid passageway (18) and said inner cross section (40) each having a lower extremity (46, 48) on the downwardmost side thereof, said lower extremity (46) of the intermediate portion of said fluid passageway (18) being displaced downwardly from said lower extremity (48) of said inner cross section (40) at a position adjacent to said neck portion (38), said wall portion (36) having a lower edge (50) and said fluid passageway (18) having an upper extremity (52), said wall portion (36) extending completely across said fluid passageway (18) and downwardly from said upper extremity (52) of said fluid passageway (18) to a position even with said lower extremity (48) of said cross section (40) of said neck portion (38).

5. An assembly as set forth in claim 4 further characterized by said fluid passageway (18) including an opening when viewed in cross section defined by said bottom edge (50) of said wall portion (36) and the remainder of said fluid passageway (18), said opening having a constricted cross sectional area relative to the remainder of said fluid passageway (18).

6. An assembly as set forth in claim 5 further characterized by including inlet fluid flow control means for gradually decreasing the cross sectional area of said fluid passageway (18) approaching said opening from said inlet end (14) of said tube (12).

7. An assembly as set forth in claim 6 further characterized by said inlet fluid flow control means including an upper surface (54) of said fluid passageway (18) blending smoothly downwardly from a point spaced from said end (14) of said snorkel tube (12) to said bottom edge (50) of said wall portion (36), said upper surface (54) gradually decreasing the effective cross sectional area of said fluid passageway (18) as it approaches said wall portion (36) for creating a flow effect which increases the efficiency of inlet fluid flow past said wall portion (36).

8. An assembly as set forth in claim 7 further characterized by said exhaust passageway (28) having a lower portion downstream of said mouthpiece (16) and below said bottom edge (50) of said wall portion (36), said assembly (10) including exhaust fluid flow control means for directing exhaust fluid flow through said lower portion of said exhaust passageway (28) whereby water trapped within said fluid passageway (18) is forced out through said exhaust passageway (28) with said exhaust flow of fluid.

9. An assembly as set forth in claim 7 further characterized by said exhaust passageway (28) including an upper extremity (56), said exhaust fluid flow control means including a second wall portion (58) extending downward from said upper extremity (56) of said exhaust passageway (28) to a position approximately even with said lower edge (50) of said first-mentioned wall portion (36).

10. An assembly as set forth in claim 9 further characterized by said first and second-mentioned wall portions (36,58) being a single integral unit.

11. An assembly as set forth in claim 10 further characterized by said second mentioned wall portion (58) including alignment means for aligning said second mentioned wall portion (58) within said exhaust passageway (28).

12. An assembly as set forth in claim 11 further characterized by said alignment means including a pair of flanges (60) extending therefrom, said exhaust valve means (24) having side surfaces including a pair of seats for mating engagement with said flanges (60).

13. An assembly as set forth in claim 9 further characterized by including an annular wall defining said neck portion (38), said annular wall including a projection (64) extending into said inner passageway (40) from said lower extremity (48) thereof adjacent to said fluid passageway (18).

14. An assembly as set forth in claim 9 further characterized by including inlet valve means (66) for allowing one-way flow of fluid into said snorkel tube (12).

15. A diving snorkel assembly (10) comprising: a snorkel tube (12) having an air inlet end (14) and an opposite end; a mouthpiece (16) at said opposite end of said tube (12), said tube (12) defining a fluid passageway (18) extending between said inlet end (14) of said tube (12) and said mouthpiece (16); exhaust valve means (24, 24') disposed between said mouthpiece (16) and said inlet end (14) of said tube (12) for allowing one-way exhaust of fluid from said fluid passageway (18); and exhaust baffling means (26, 26') for establishing an exhaust fluid flow from said mouthpiece (16) through said fluid passageway (18) toward said exhaust valve means (24, 24') in response to air pressure from said mouthpiece, said exhaust valve means (24, 24') defining an exhaust passageway (28) extending laterally from and in fluid communication with one side of said fluid passageway (18), said baffling means (26, 26') including a wall portion (36, 36') extending inwardly from the opposite side of said fluid passageway (18) and toward said exhaust passageway (28) to direct the flow of exhaust fluid through said fluid passageway (18) into said exhaust passageway (28), and a neck portion (86) extending from said mouthpiece (16), said neck portion (86) being substantially L-shaped and including a first leg (88) extending from said mouthpiece (16) and a second leg (90) extending substantially perpendicular relative to said first leg (88) to said inlet end (14), said exhaust valve means (24) extending from said second leg (90) and being spaced from said inlet end (14).

16. An assembly as set forth in claim 15 further characterized by said wall portion (36') extending substantially across said fluid passageway (18) from said tube (12) opposite to said exhaust valve means (24').

17. An assembly as set forth in claim 16 further characterized by said wall portion (36') having an upstream side (92) and a downstream side (94) each having a smooth curved surface merging with said fluid passageway (18).

18. An assembly as set forth in claim 16 further characterized by said wall portion having a sharp peripheral end (96) and by said upstream and downstream sides (92,94) merging together towards said exhaust valve means (24') at said sharp peripheral end (96).

19. An assembly as set forth in claim 18 further characterized by said exhaust valve (24') means extending from said tube (12) at a direction opposite to said first leg of said tube (12).

20. In a snorkel structure having wall means forming a snorkel tube defining a single flow passage therein with an inlet at one end and a mouthpiece at the other; first one way valve means at said inlet end of said tube for allowing fluid flow into said tube upon inhalation at the mouthpiece and blocking fluid flow out of said tube upon exhalation; second one way exhaust valve means communicating with said flow passage between the mouthpiece and said inlet end and located at one side of said tube, said second one way exhaust valve means allowing fluid flow out of said tube upon exhalation at the mouthpiece and blocking fluid into said tube upon inhalation; baffle means projecting laterally inwardly from said wall means only partially across said tube immediately adjacent said exhaust valve means (24,24') for allowing inlet flow from said inlet end (14) past said exhaust valve means to said mouthpiece (16) and for abruptly changing the course of flow from along the snorkel tube transversely to said second one way exhaust valve means.

21. The snorkel structure as set forth in claim 20 in which said second one way exhaust valve means is located at said wall means and is exposed to the interior of said snorkel tube intermediate to the ends thereof.

22. A diving snorkel assembly (10) comprising: a snorkel tube (12) having an air inlet end (14) and an opposite end, a one way inlet valve means (66) at said inlet end (14) for allowing flow into said tube (12), a mouthpiece (16) at said opposite end of said tube (12), said tube (12) defining a single fluid passageway (18) extending between said inlet end (14) of said tube (12) and said mouthpiece (16), exhaust valve means (24, 24') communicating with said fluid passageway (18) and disposed between said mouthpiece (16) and said inlet end (14) of said tube (12) and on one side of said fluid passageway (18) for allowing one-way exhaust of fluid from said fluid passageway (18) of said tube (12), and exhaust baffling means (26, 26') extending transversely from one side of said fluid pasaageway (18) immediately adjacent said exhaust valve means (24,24') for allowing inlet flow from said inlet end (14) past said exhaust valve means to said mouthpiece (16) and substantially across said fluid passageway (18) for positively blocking and redirecting exhaust fluid flow toward said exhaust valve means (24, 24')

23. A dividing snorkel assembly (10) comprising: a snorkel tube (12) including a single fluid passageway (18), a one-way inlet (14) disposed at one end of said fluid passageway (18) and a mouthpiece (16) at an opposite end of said fluid passageway (18) for sucking air into said passageway (18) through said one-way inlet (14), exhaust valve means (24, 24') communicating with said fluid passageway (18) and disposed between said mouthpiece (16) and said one-way inlet (14) of said tube (12) and on side of said fluid passageway (18) for allowing one-way exhaust of fluid from said fluid passageway (18), and exhaust baffling means (26, 26') disposed directly in the path of fluid flow in said fluid passageway (18) immediately adjacent said exhaust valve means (24,24') for allowing inlet flow from said inlet end (14) past said exhaust valve means to said mouthpiece (16) and and extending substantially transversely into and across said fluid passageway (18) for positively redirecting exhaust fluid flow from a direction transversely to said baffling means (26, 26') through a turn and into a direction generally parallel to said baffling means (26, 26') and toward said exhaust valve means (24, 24') to prevent water between said baffling means and said mouthpiece from flowing past said exhaust valve means (24, 24') and is directed out of said exhaust valve means (24, 24') during exhalation and air entering said fluid passageway (18) from said one-way air inlet (14) is allowed to flow past said exhaust baffling means (26, 26') toward said mouthpiece (16) during inhalation.

* * * * *